US005248081A

United States Patent [19]

Hook

[11] Patent Number: 5,248,081

[45] Date of Patent: Sep. 28, 1993

[54] CARRYING CONTAINER FOR FOOD PRODUCT

[76] Inventor: Dennis D. Hook, 1504 S. Bay Villa Pl., Tampa, Fla. 33629

[21] Appl. No.: 907,800

[22] Filed: Jul. 2, 1992

[51] Int. Cl.[5] ..... B65D 5/42; B65D 5/46

[52] U.S. Cl. ..... 229/117.14; 206/298; 206/395; 206/493; 229/103; 229/162; 426/110; 426/129

[58] Field of Search ..... 229/117.14, 117.15, 229/162, 103; 206/298, 391, 395, 408, 485, 491, 493; 426/106, 110, 124, 129

[56] References Cited

U.S. PATENT DOCUMENTS

| | | | |
|---|---|---|---|
| 1,192,168 | 7/1916 | Cook | 206/395 |
| 1,691,995 | 11/1928 | Saulter | 206/395 |
| 1,987,491 | 1/1935 | Nejelski | 426/129 |
| 2,550,417 | 4/1951 | Klein | 229/162 |
| 2,701,089 | 2/1955 | Fischer | 229/162 |
| 2,959,339 | 11/1960 | Sierk et al. | 206/485 |
| 3,054,682 | 9/1962 | Russell et al. | 426/129 |
| 3,150,769 | 9/1964 | Cohn | 229/117.14 |
| 3,181,772 | 5/1965 | Collins et al. | 229/117.14 |
| 3,384,228 | 5/1968 | Cannon | 206/485 |
| 3,399,819 | 9/1968 | Rennie et al. | 426/129 |
| 3,613,973 | 10/1971 | Jaeschke | 206/395 |
| 3,799,424 | 3/1974 | Mayea | 229/162 |
| 3,981,400 | 9/1976 | Quintana | 206/408 |

FOREIGN PATENT DOCUMENTS

| | | | |
|---|---|---|---|
| 7712577 | 7/1979 | Switzerland | 206/408 |
| 4841 | of 1912 | United Kingdom | 206/408 |

*Primary Examiner*—Gary E. Elkins
*Attorney, Agent, or Firm*—Frijouf, Rust & Pyle

[57] ABSTRACT

An apparatus and method is disclosed for an improved carrying container for a food product such a roasted fowl, ham or the like impaled on a skewer rod. The, container comprises a bottom wall and side wall elements with a first and a second aperture defined in opposed walls. The skewer rod ends are insertable within the first and second apertures in the opposed walls for supporting the food product within the container interior of the container. The first and second apertures are positioned for spacing the food product from the bottom wall and the side wall elements.

10 Claims, 6 Drawing Sheets

CARRYING CONTAINER FOR FOOD PRODUCT

BACKGROUND OF THE INVENTION

1. Field Of The Invention

This invention relates to carrying containers and more particularly to an improved carrying container for a food product impaled on a skewer rod.

2. Background Of The Invention

In the last several decades, fast food restaurants have gained enormous popularity within the United States and to some extent throughout the world. Typically, fast food restaurants provide quality food at economical prices with extremely rapid service relative to conventional restaurants. The fast food restaurant provide a take-out service of the fast food as well as providing modest facilities for the consumption of the food products on the premises.

The recent success and popularity of fast food restaurants and grocery store delicatessens have encouraged other restaurants to provide a take-out service. One problem associated with take out service in the past has been the interaction of the food product with the container required for the take-out order. It is well known that many food products which have a desirable appearance in a display warmer are substantially degraded by the packaging of the food product required by the take-out order. Accordingly, when the consumer subsequently opened the container, the food product did not have the same appearance nor the desirability of the food product originally selected from the display warmer.

This difficulty in packaging of take-out food product is particularly aggravated with roasted food product such as chicken, turkey and hams. When the turkeys, chickens or hams were placed within a container, the skin of the food product was bruised thus compromising the integrity of the skin, causing a degradation in the taste and quality of the product. Furthermore, any moisture within the food product typically permeated to the bottom of the food product making the top of the food product dry and providing a soggy bottom portion. This permeation of moisture was especially true in fowl wherein the fowl was typically placed in a container with the breast portion upwardly disposed. The breast portion, which is the driest part of the fowl, would loose moisture to the bottom of the fowl which is already the most moist portion of the fowl. Furthermore, the lower portion of the fowl was in direct contact with the container, thus enhancing the cooling of the lower portion of the fowl and possibly allowing the food product to absorb any taste from the container material.

Therefore, it is an object of the present invention to provide an improved container and a method for transporting a food product impaled on a skewer rod which overcomes the above problems of the prior art containers.

Another object of this invention is to provide an improved carrying container for a food product impaled on a skewer rod such as roasted fowl, ham or the like.

Another object of this invention is to provide an improved carrying container for a food product impaled on a skewer rod wherein the food product is suspended in the container to be spaced from the bottom and the side walls of the container for maintaining the integrity and taste of the food product.

Another object of this invention is to provide an improved carrying container wherein the food product is suspended in the container to be spaced from the bottom and the side walls of the container for enhancing the moisture content of the breast portion of a fowl food product.

Another object of this invention is to provide an improved carrying container for a food product impaled on a skewer rod wherein the food product has substantially the same appearance and taste as the food product appeared to the consumer in a display warmer.

Another object of this invention is to provide an improved carrying container wherein a prior art container may be easily modified for incorporating the present invention.

Another object of this invention is to provide an improved carrying container that is easy to manufacture with only a moderate increase in cost.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved carrying container for a food product impaled on a skewer rod having a first and a second rod end comprising a container having a bottom wall and side wall means for defining a container interior. The side wall means includes a first and a second opposed wall with a first and a second aperture defined in the first and second opposed walls. The first and second rod ends of the skewer rod are insertable within the first and second apertures in the first and second opposed walls, respectively, for supporting the food product within the container interior of the container. The first and second apertures are positioned in the first and second opposed walls for spacing the food product from the bottom wall and the side wall means.

In a more specific embodiment of the invention, the container comprises a cardboard container formed from a unitary cardboard blank. The side wall means defines a container opening with a container cover engagable with the side wall means for closing the container opening. In one embodiment of the invention, the container cover is integrally formed with the container. An optional carrying handle may be secured to the container for facilitating the transportation of the container. In another embodiment of the invention, the side wall means includes a portion thereof being transparent for enabling the observation of the food product within the container interior of the container.

In one embodiment of the invention, the first and second apertures comprise a notch defined in an end of the first and second opposed walls, respectively. In another embodiment of the invention, the first and second apertures comprise an expandable aperture defined in the first and second opposed walls, respectively. Preferably, the skewer rod is rotatable within the first and second apertures for enabling a fowl food product to be suspended with the breast portion of the fowl positioned downwardly for enhancing the moisture content of the breast portion of the fowl.

In still a further embodiment of the invention, the skewer rod includes an annular recess located proximate to the first rod end with the annular recess of the skewer rod receiving an edge of the first aperture in the first opposing wall for inhibiting axial displacement of the skewer rod relative to the side wall means of the container. The skewer rod is usable as a toy drum stick after removable from the container and after removal of the impaled food product.

The invention is also incorporated into the method of transporting a food product from a warming cabinet for consumption at a later time when the food product is impaled on a skewer rod. The method comprises the steps of removing the food product and the skewer rod from the warming cabinet and positioning the food product and the skewer rod in a container. A first and a second end of the skewer rod is positioned into a first and second aperture in the container for supporting the food product within the container with the food product being spaced from a bottom wall and side wall of the container. Preferably, the skewer rod in the first and second apertures is rotatably mounted for enabling a fowl food product to be suspended with the breast portion of the fowl positioned downwardly for enhancing the moisture content of the breast portion of the fowl.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
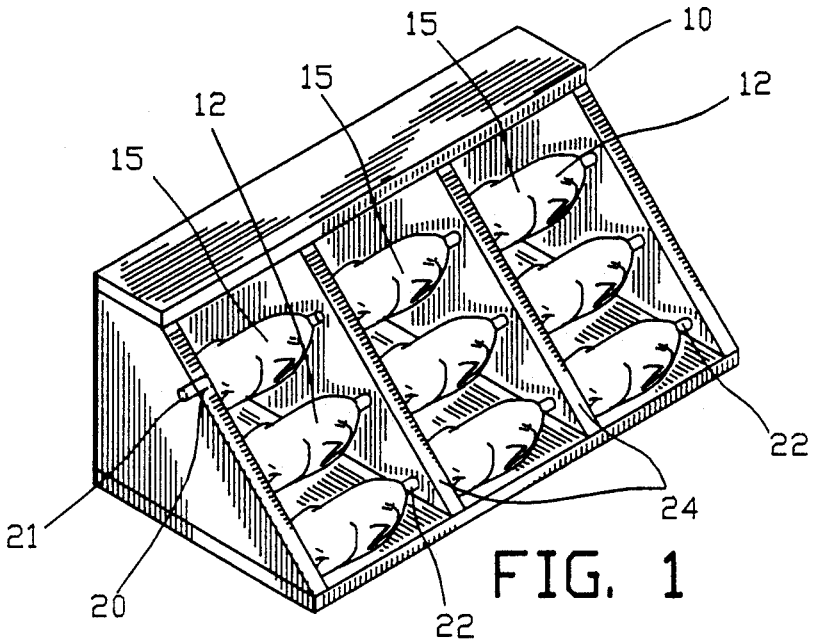
FIG. 1 is an isometric view of a warming cabinet for storing and displaying food products on skewer rods.
Figure 2:
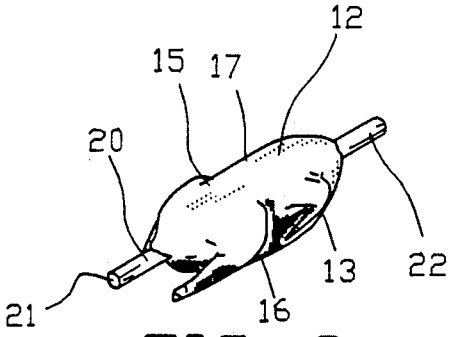
FIG. 2 is an isometric view of the food product removed from the warming cabinet.

FIG. 1 is an isometric view of a warming cabinet 10 for storing and displaying food products 12 having an outer skin 13 shown as whole fowl 15. As shown in an enlarged view in FIG. 2, each of the whole fowl 15 has a breast portion 16 and a back portion 17 and is impaled on a skewer rod 20 extending between a first rod end 21 and a second rod end 22. The skewer rod 20 is impaled through the food products 12 with the first and second rod ends 21 and 22 extending therefrom.

The food products 12 are supported within the display warmer 10 by racks 24 engaging the first and second rod ends 21 and 22 of the skewer rod 20. Since the food products 12 are supported within the display warmer 10, the integrity of the outer surface 13 of the food product 12 is maintained since the food product 12 is not resting on a support surface. The display warmer 10 maintains the food products 12 at an elevated temperature as well as providing a desirable appearance to the consumer Although the food products 12 have been shown as whole fowl 12, it should be understood that the food products 12 may comprise any food product impaled by a skewer rod 20 such as a turkey, ham, roast and the like.

Figure 3:
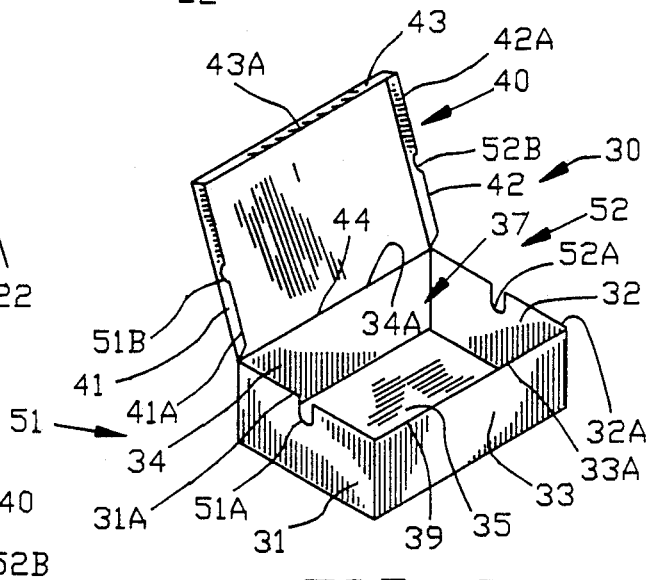
FIG. 3 is an isometric view of a first embodiment of an improved carrying container of the present invention with a container cover in an open position.

FIG. 3 is an isometric view of a first embodiment of an improved carrying container 30 having side wall means 31-34 and a bottom wall 35 defining a container interior 37. The side wall means 31-34 terminate in side wall edges 31A-34A defining a container opening 39. The side wall means 31-34 includes a first and a second opposed wall 31 and 32 disposed substantially parallel to one another.

Preferably, the container 30 is constructed of a cardboard material and formed from a unitary cardboard blank that is die cut folded and glued for forming the completed container 30 as shown. The container 30 may incorporate various configurations and construction techniques which should be well known to those skilled in the art. In addition, the container 30 may be constructed of a foam or polymeric material as should likewise well known to those skilled in the art.

Figure 6:
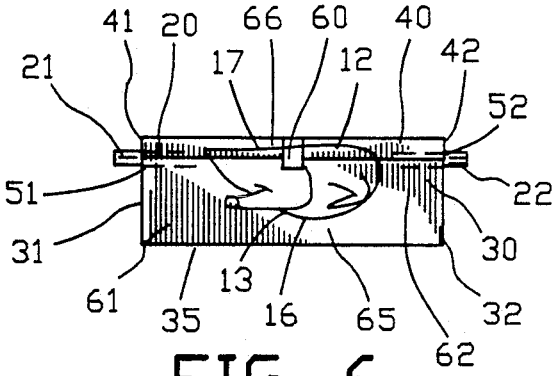
FIG. 6 is a front view of FIG. 5.
Figure 7:
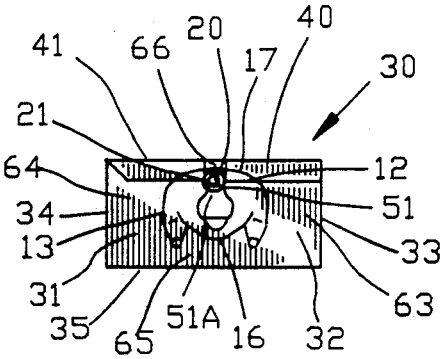
FIG. 7 is a left side view of FIG. 5.

A cover 40 has a cover rim comprising rim elements 41-43 including a first and a second opposed rim element 41 and 42. The rim elements 41-43 terminate in rim edges 41A-43A. The cover 40 is integrally joined to the container 30 through a flexible fold or hinge 44 for moving the cover 40 between an open position shown in FIGS. 3 and 4 and a closed position shown in FIGS. 5-7. When the cover 40 is disposed in the closed position as shown in FIGS. 5-7, the rim elements 41-43 respectively engage the side wall means 31-33.

A first and a second aperture 51 and 52 comprises a first and a second container notch 51A and 52A defined in the first and second opposed walls 31 and 32 of the container 30. The first and second apertures 51 and 52 also comprises a first and a second rim notch 51B and 52B defined in the first and second opposed rim elements 41-42.

Figure 4:
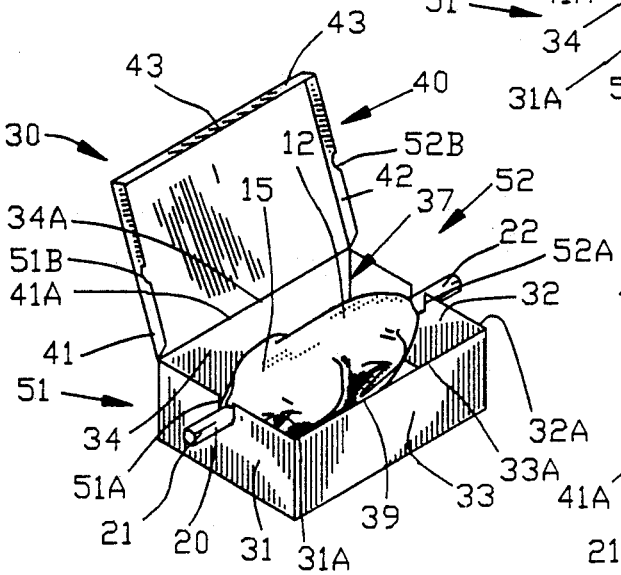
FIG. 4 is an isometric view similar to FIG. 3 with the food product disposed within an interior of the container.

FIG. 4 is an isometric view similar to FIG. 3 with the food product 12 disposed within the interior 37 of the container 30. The first and second rod ends 21 and 22 of the skewer rod 20 are inserted within the first and second container notches 51A and 52A for supporting the food product 12 within the container interior 37 of the container 30.

Figure 5:
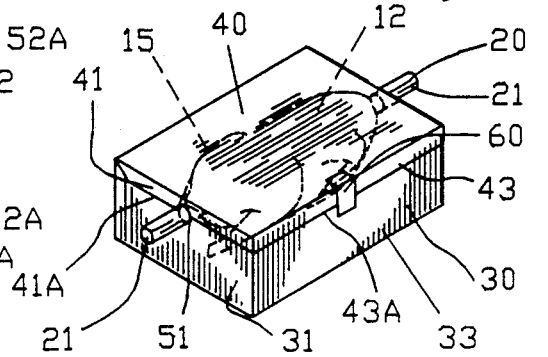
FIG. 5 is an isometric view similar to FIG. 4 with the container cover in a closed position.

FIG. 5 is an isometric view similar to FIG. 4 with the container cover 40 in a closed position with the rim elements 41-43 of the cover 30 respectively engaging with the side wall means 31-33. When the cover 30 is in the closed position, the first and second rod ends 21 and 22 of the skewer rod 20 are received within the first and second cover notches 51B and 52B of the opposed rim elements 41 and 42. Preferably, the cover 40 is secured to the container 30 by tape 60 or a mechanical fastener (not shown). The tape 60 or a mechanical faster (not shown) may bias the first and second cover notches 51B and 52B of the opposed rim elements 41 and 42 into engagement with the first and second rod ends 21 and 42 of the skewer rod 20 to prevent axial movement of the skewer rod 20. The inhibiting of the axial movement of the skewer rod 20 insures that the food product 12 does not contact the opposed side walls 31 and 32.

FIGS. 6 and 7 are front and side views of FIG. 5 respectively. The first and second apertures 51 and 52 are positioned for spacing the food product 12 from the bottom wall 35 and the side wall 31-34. The food product 12 is suspended in the container 30 for spacing the food product 12 from the side wall 31-34 by spacings 61-64 and is spaced from the bottom wall 35 and the cover 40 by spacings 65 and 66. The spacings 61-66 prevent the food product 12 from contacting the container 30 for preventing damage to the outer surface 13 of the food product 12. Accordingly, the improved container 30 of the present invention maintains the integrity and taste of the food product 12. Furthermore, since the food product does not contact the container 30, the possibility of the taste of the food product 12 being deteriorated through the contact with the container 30 is thereby eliminated through the practice of the present invention. Furthermore, the food product 12 does not rest on the bottom wall 37 of the container 30 and does not absorb accumulated moisture and grease located on the bottom wall 35 of the container 30.

Preferably, the skewer rod 20 is rotatable within the first and second apertures 51 and 52. When the skewer rod 20 is properly impaled in the fowl 15, the weight distribution of the fowl 15 rotates the skewer rod 20 for enabling a whole fowl 15 to be suspended with the breast portion 16 of the fowl 15 positioned downwardly. It is well known in the art that the breast portion 16 of a fowl 15 is dryer than the back portion 17 of the fowl 16. In this position, the moisture in the back portion 17 of the fowl 15 permeates to the breast portion 16 of the fowl 15 for enhancing the moisture content of the breast portion 16. With the practice of the present invention, the food product 12 has substantially the same appearance and taste as the food product 12 appearing to the consumer in the display warmer 10.

Figure 8:
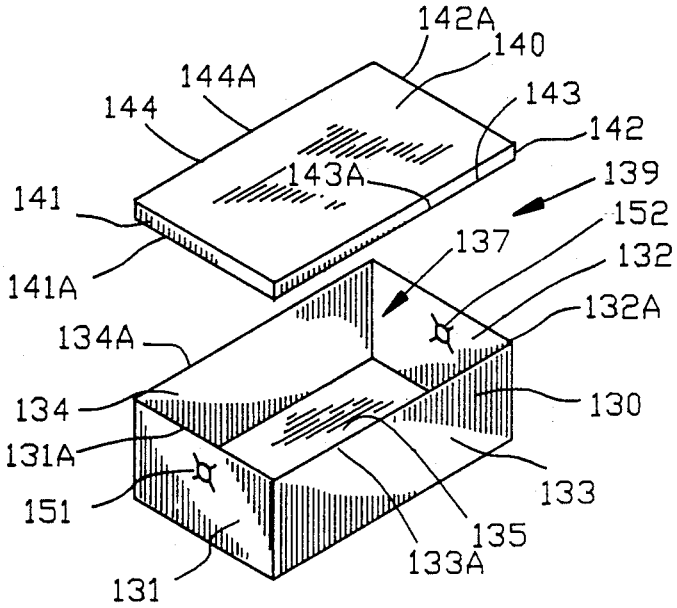
FIG. 8 is an isometric view of a second embodiment of an improved carrying container of the present invention with a container cover in an open position

FIG. 8 is an isometric view of a second embodiment of an improved carrying container 130 having side wall means 131-134 and a bottom wall 135 defining a container interior 137. The side wall means 131-134 terminate in side wall edges 131A-134A defining a container opening 139. The side wall means 131-134 include a first and a second opposed wall 131 and 132 disposed substantially parallel to one another.

A cover 140 has a cover rim comprising rim elements 141-144 terminating in rim edges 141A-144A and including a first and a second opposed rim element 141 and 142. Expandable first and second apertures 151 and 152 are defined in the first and second opposed walls 131 and 132 of the container 130.

Figure 8A:
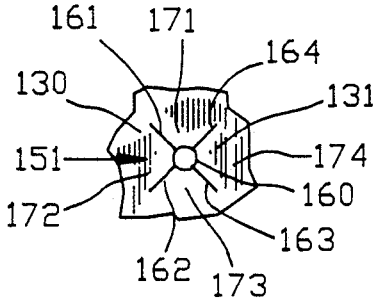
FIG. 8A is an enlarged partial left side view of FIG. 8.

FIG. 8A is an enlarged partial left side view of FIG. 8 further illustrating the expandable first aperture 151. The expandable first aperture 151 includes a central orifice 160 and a plurality of radial extending cuts 161-164. The central orifice 160 has a diameter less than the diameter of the skewer rod 120 whereas the plurality of radial extending cuts 161-164 define tabs 171-174 having a diameter greater than the diameter of the skewer rod 120.

Figure 9:
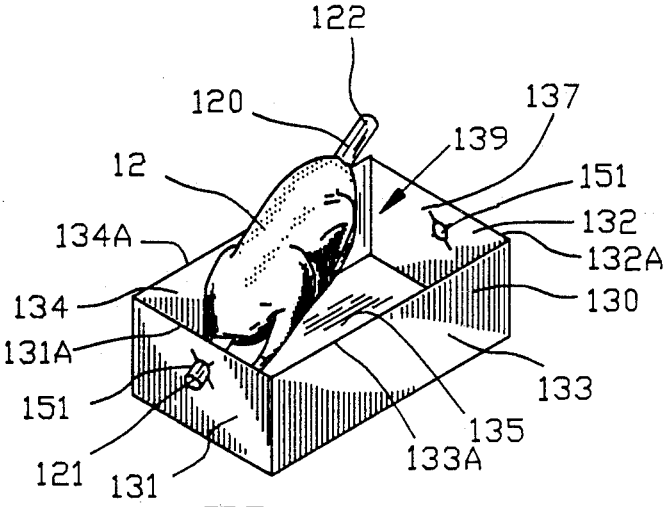
FIG. 9 is an isometric view similar to FIG. 8 with the food product being inserted within an interior of the container.

FIG. 9 is an isometric view similar to FIG. 8 with the food product 12 being inserted within the container interior 137 of the container 130. The first rod end 121 of the skewer rod 120 is inserted within the expandable first aperture 151.

Figure 9A:
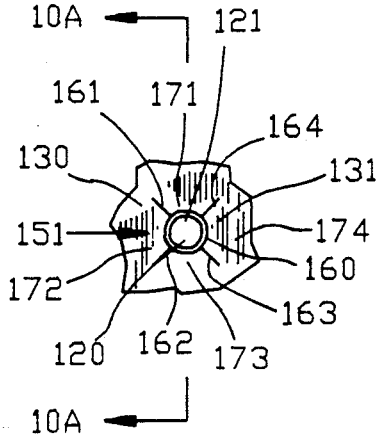
FIG. 9A is an enlarged partial left side view of FIG. 9.

FIG. 9A is an enlarged partial left side view of FIG. 9 further illustrating the insertion of the first rod end 121 into the expandable first aperture 151. The insertion of the first rod end 121 deflects tabs 171-174 outwardly for enabling the expandable first aperture 151 to receive the first end 121 of the skewer rod 120.

Figure 10:
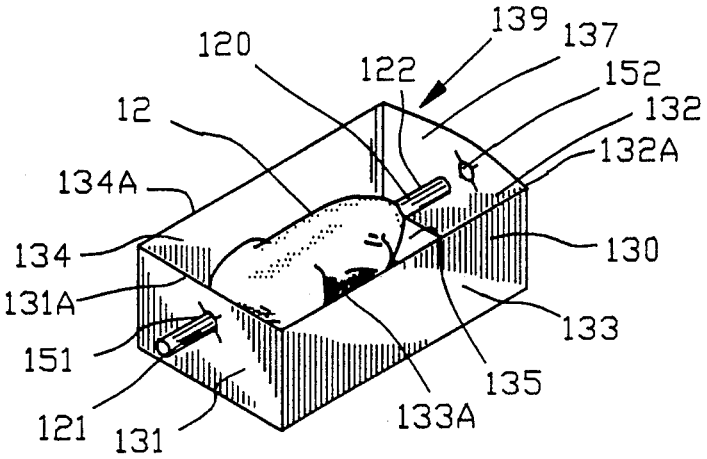
FIG. 10 is an isometric view similar to FIG. 9 illustrating continued insertion of the food product within the interior of the container.

FIG. 10 is an isometric view similar to FIG. 9 with the food product 12 being inserted within the container interior 137 of the container 130. The second opposing wall 132 is shown deformed outwardly to provide adequate room for enabling the second end 122 of the skewer rod 120.

Figure 10A:
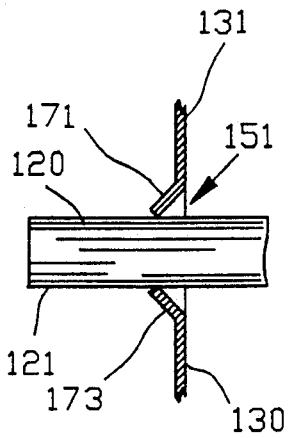
FIG. 10A is an enlarged sectional view along line 10A—10A in FIG. 10.

FIG. 10A is an enlarged sectional view along line 10A-10A in FIG. 9A illustrating the outward deflection of the tabs 171-174 for receiving the first end 121 of the skewer rod 120. The orientation of the plurality of radial extending cuts 161-164 causes the tabs 171-174 to be biased against the first end 121 of the skewer rod 120 to inhibit axial movement of the skewer rod 120. The inhibiting of the axial movement of the skewer rod 120 insures that the food product 12 does not contact the opposed side walls 131 and 132.

Figure 11:
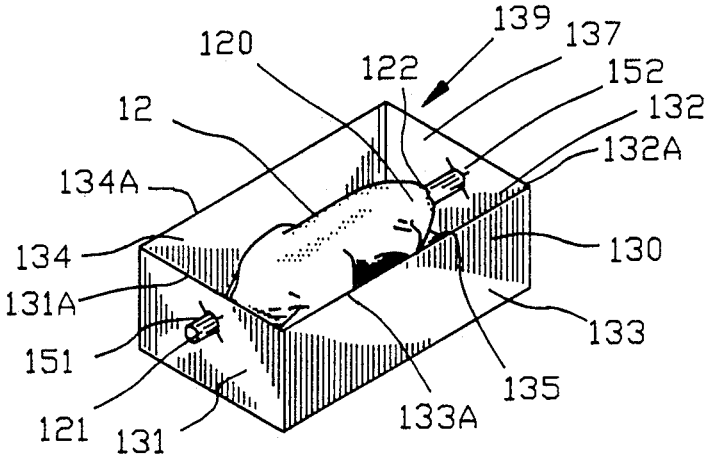
FIG. 11 is an isometric view similar to FIG. 10 with the food product being fully inserted within the interior of the container.

FIG. 11 is an isometric view similar to FIG. 10 with the food product 12 being fully inserted within the container interior 137 of the container 130. The second rod end 122 is illustrated inserted into the expandable second aperture 152. The expandable second aperture 152 operates in a manner identical to the expandable first aperture 151 shown in FIGS. 8A, 9A and 10A.

Figure 12:
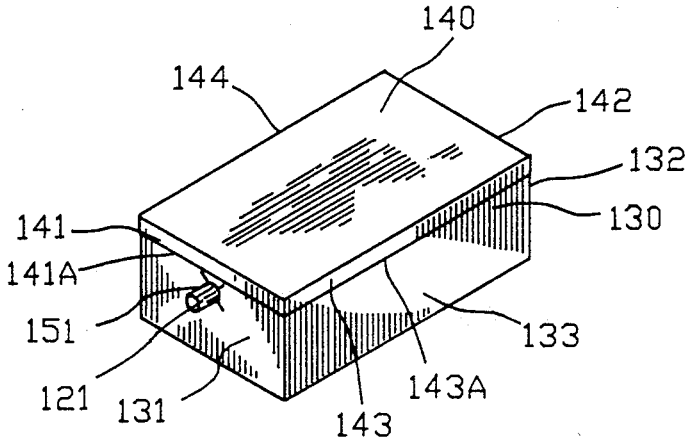
FIG. 12 is an isometric view similar to FIG. 11 with the container cover in a closed position.

FIG. 12 is an isometric view similar to FIG. 11 with the container cover 140 positioned on the container 130 for closing the container opening 139. The container cover 140 may be secured to the container 130 by suitable means that should be well known to those skilled in the art.

Figure 13:
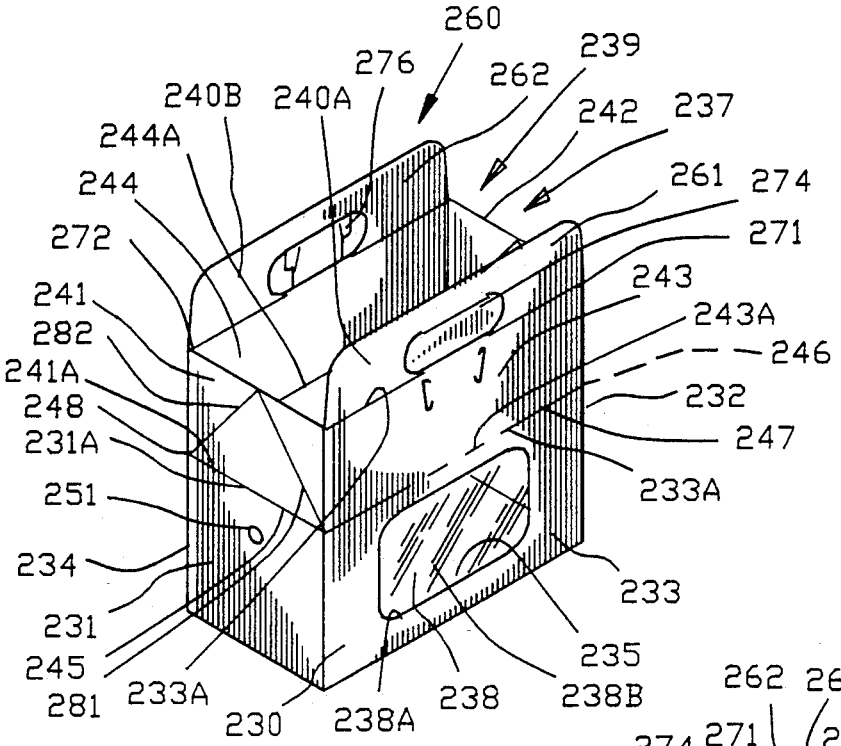
FIG. 13 is an isometric view of a third embodiment of an improved carrying container of the present invention with a container cover in an open position.
Figure 14:
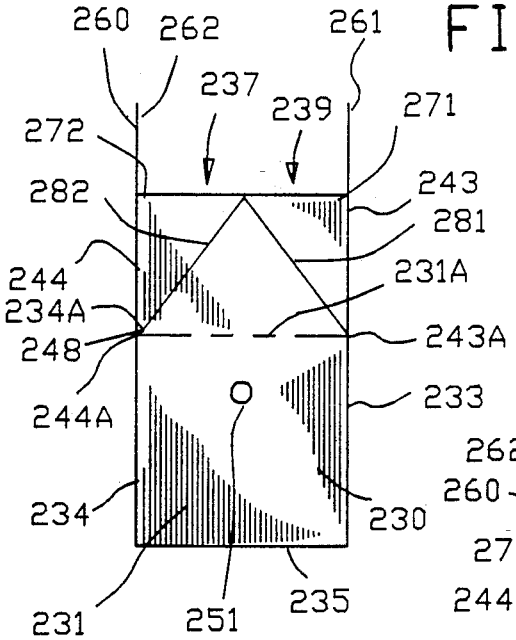
FIG. 14 is a left side view of FIG. 13.

FIGS. 13 and 14 are isometric and side views of a third embodiment of an improved carrying container 230 having side wall means 231-234 and a bottom wall 235 defining a container interior 237. The side wall means 231-234 terminate in side wall edges 231A-234A defining a container opening 239. The side wall means 231-234 include a first and a second opposed wall 231 and 232 disposed substantially parallel to one another.

In this embodiment, the side wall means 233 includes a transparent window 238 comprising a cut-out 238A in the side wall means 233 covered by a transparent plastic film 238B. The transparent plastic film 238B may be secured to the side wall means 233 by a suitable adhesive (not shown). The transparent window 238 enables the observation of the food product 12 within the container interior 237 of the container 230.

A cover 240 comprises cover elements 241-244 having elements edges 241A-244A that are integrally secured to the side wall edges 231A-234A of the side wall means 231-234 by hinges 245-248. A first and a second aperture 251 and 252 is defined in the first and second opposed walls 231 and 232 of the container 230.

A carrying handle 260 comprising a first and a second handle portion 261 and 262 is secured to the container 230 for facilitating the transportation of the container 230. In this embodiment of the invention, the first and second handle elements 261 and 262 are integrally formed with the cover elements 243 and 244 by hinges 271 and 272. The first and second handle elements 261 and 262 include handle openings 274 and 276 for defining a handle opening.

Figure 15:
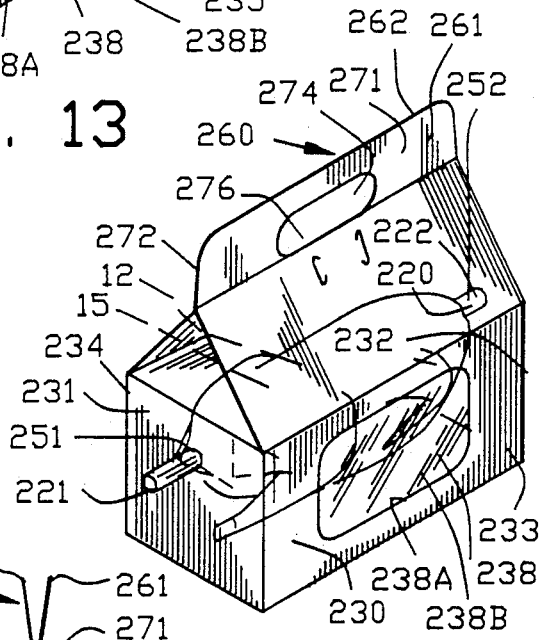
FIG. 15 is an isometric view similar to FIG. 13 with the food product being inserted within an interior of the container with a container cover in a closed position.
Figure 16:
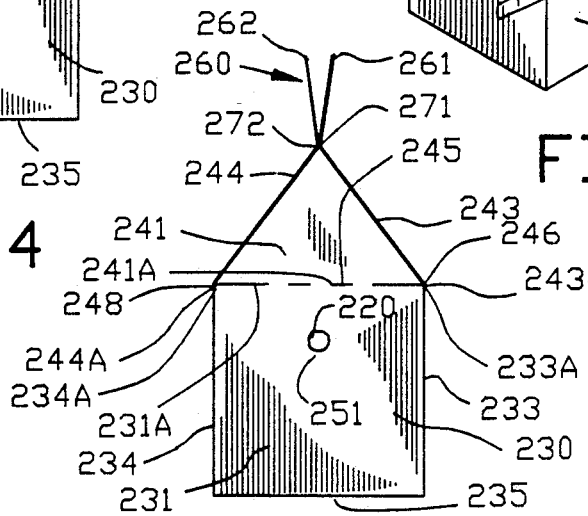
FIG. 16 is a left side view of FIG. 15.

FIGS. 15 and 16 are isometric and side views of the third embodiment of the improved carrying container 230 with a container cover 240 in a closed position. The cover 240 is closed by folding the container 230 along lines 281 and 282 and hinges 245-248 to position the first and second handle portions 261 and 262 adjacent to one another. The first and a second handle portions 261 and 262 are secured to one another by suitable means (not shown) for forming the carrying handle 260 for facilitating the transportation of the container 230. It should be appreciated by those skilled in the art that the cover 240 and carrying handle 260 may be formed and secured in various ways that should be well known to those skilled in the packaging art.

The food product 12 shown as a fowl 15 has been impaled by a skewer rod 220. A first and a second rod end 221 and 222 of the skewer rod 220 have been inserted within the first and second apertures 251 and 252 for supporting the fowl 15 within the container interior 237 of the container 230. The first and second apertures 251 and 252 are located in the first and second opposed walls 231 and 232 such that the fowl 15 appears in the transparent window 238 to allow the observation of the fowl 15 within the container 230.

Figure 17:
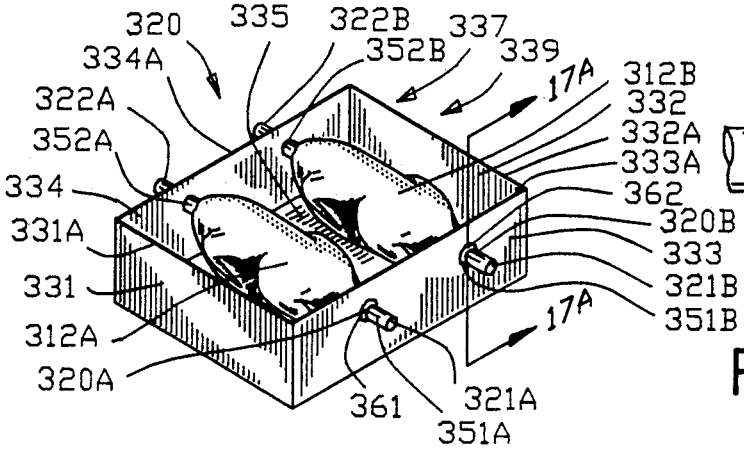
FIG. 17 is an isometric view of a fourth embodiment of an improved carrying container of the present invention with a container cover in an open position.

FIG. 17 is an isometric view of a fourth embodiment of an improved carrying container 320 having side wall means 331-334 and a bottom wall 335 defining a container interior 337. The side wall means 331-334 terminate in side wall edges 331A-334A defining a container opening 139. The side wall means 331-334 include a first and a second opposed wall 333 and 334 disposed substantially parallel to one another. A first pair of apertures 351A and 351B and a second pair of apertures 352A and 352B are defined in the first and second opposed walls 333 and 334 of the container 330.

A first and second food product 312A and 312B are impaled on first and second skewer rods 320A and 320B. First rod ends 321A and 321B of the first and second skewer rods 320A and 320B are inserted into the first pair of apertures 351A and 351B whereas the second rod ends 322A and 322B of the first and second skewer rods 320A and 320B are inserted into the second pair of apertures 352A and 352B. This embodiment of the invention permits multiple food products 312A and 312B to be suspended in the container 320.

Plural outer clips 361 and 362 are secured to the first rod ends 321A and 321B of the first and second skewer rods 320A and 320B for inhibiting of the axial movement of the first and second skewer rods 320A and 320B to insure that the food products 312A and 312B do not contact the opposed side walls 333 and 334.

Figure 17A:
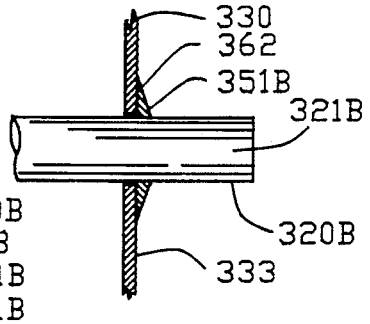
FIG. 17A is an enlarged sectional view along line 17A-17A in FIG. 17.

FIG. 17A is an enlarged sectional view along line 17A-17A in FIG. 17 illustrating the outer clip 362. Preferably, the plural outer clips 361 and 362 are secured to the first rod ends 321A and 321B of the first and second skewer rods 320A and 320B by frictional means to engage with or to secure to the side wall 333 of the container 330.

Figure 18:
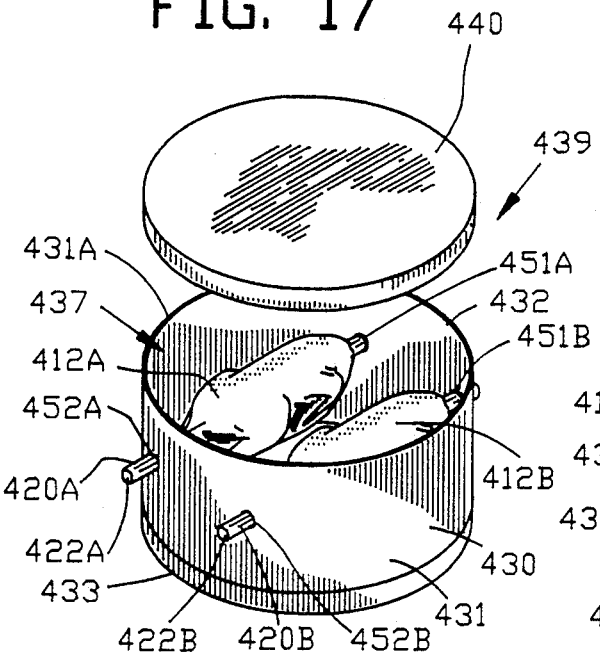
FIG. 18 is an isometric view of a fifth embodiment of an improved carrying container of the present invention with a container cover in an open position.
Figure 19:
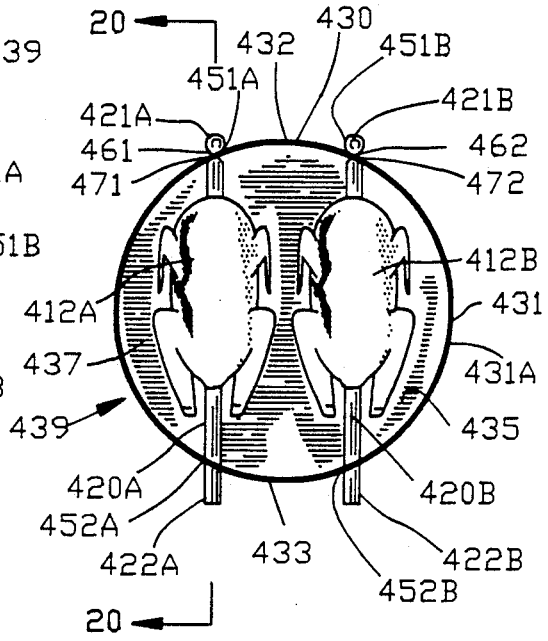
FIG. 19 is a top view of FIG. 17.
Figure 20:
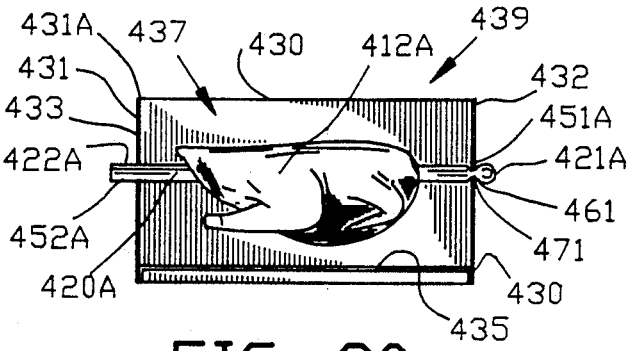
FIG. 20 is a sectional view along line 20—20 in FIG. 19.

FIG. 18 is an isometric view of a fifth embodiment of a container 430 with a container cover 440 in an open position. FIG. 19 is a rotated top view of FIG. 18 whereas FIG. 20 is a sectional view along line 20—20 in FIG. 19. The container 430 has a generally cylindrical side wall means 431 and a bottom wall 435 defining a container interior 437. The side wall means 431 terminates in side wall edges 431A defining a container opening 439. The side wall means 431 includes a first and a second opposed wall portions 432 and 433. A first pair of apertures 451A and 451B and a second pair of apertures 452A and 452B are defined in the first and second opposed wall portions 432 and 433 of the container 430.

A first and second food product 412A and 412B are impaled on first and second skewer rods 420A and 420B. First rod ends 421A and 421B of the first and second skewer rods 420A and 420B are inserted into the first pair of apertures 451A and 451B whereas the second rod ends 422A and 422B of the first and second skewer rods 420A and 420B are inserted into the second pair of apertures 452A and 452B. The first and second skewer rods 420A and 420B have annular recesses 461 and 462 located proximate to the first rod ends 421A and 421B of the first and second skewer rods 420A and 420B. This embodiment of the invention permits multiple food products 412A and 412B to be suspended in the container 420.

Figure 21:
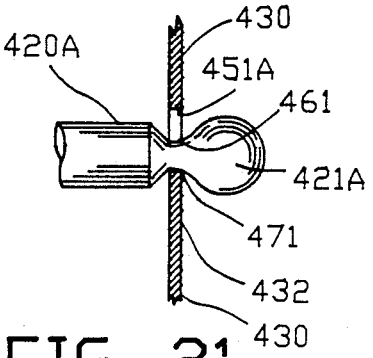
FIG. 21 is an enlarged partial view of FIG. 20.

FIG. 21 is an enlarged partial view of FIG. 20 illustrating the first skewer rod 420A with the annular recess 461 located proximate to the first rod end 421A. The annular recess 461 of the first skewer rod 420A receives an edge 471 of the first aperture 451A in the first opposing wall 432 for inhibiting axial displacement of the first skewer rod 420A relative to the side wall means 431 of the container 430. In a similar manner, the annular recess 462 of the second skewer rod 420B receives an edge 472 of the second aperture 451B in the first opposing wall 432 for inhibiting axial displacement of the second skewer rod 420B relative to the side wall means 431 of the container 430.

Figure 22:
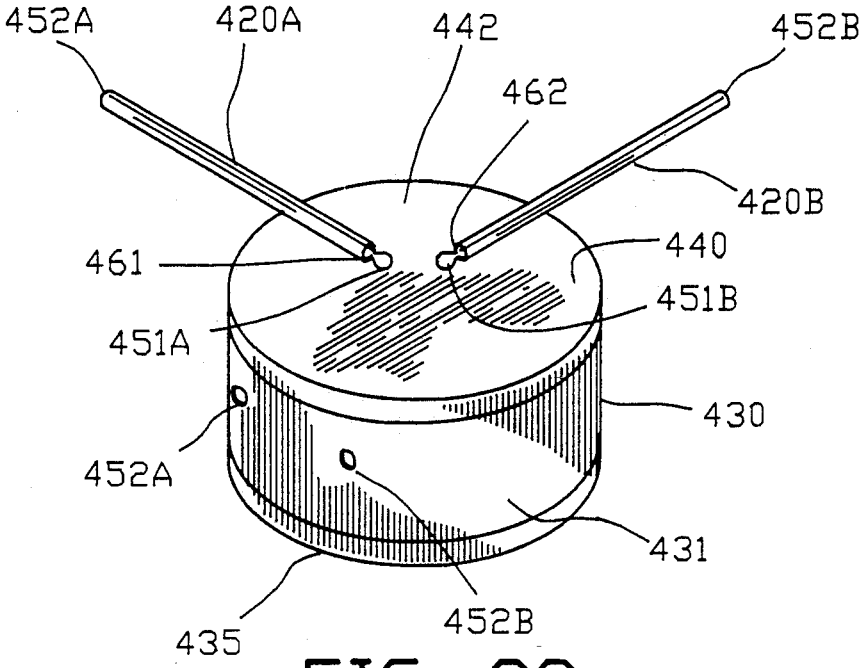
FIG. 22 is an isometric view of the improved carrying container and the skewer rods provide an entertainment toy drum.

FIG. 22 is an isometric view of the improved carrying container 430 and the first and second skewer rods 420A and 420B after consumption of the food products 412A and 412B. The cover 440 is secured to the container 430 for providing a toy drum surface 442. The first and second skewer rods 420A and 420B are usable as toy drum sticks to provide an entertainment toy drum.

The invention is also incorporated into the method of transporting a food product 12 from a warming cabinet 10 for consumption at a later time when the food product 12 is impaled on the skewer rod 20. The method comprises removing the food product 12 and the skewer rod 20 from the warming cabinet 10 and positioning the food product 12 and the skewer rod 20 in a container 30. The first and second ends 21 and 22 of the skewer rod 20 are inserted into the first and second apertures 51 and 52 in the container 30 for supporting the food product 12 within the container 30 with the food product 12 being spaced from a bottom wall 35 and the side walls 31–34 of the container 30. The skewer rod 20 is rotatably mounted on the first and second apertures 51 and 52 for enabling a fowl food product 15 to be suspended with the breast portion 16 of the fowl positioned downwardly for enhancing the moisture content of the breast portion 16 of the fowl 15.

The present invention provides an improved container and a method for transporting a food product impaled on a skewer rod such as roasted fowl, ham or the like. The food product is suspended in the container to be spaced from the bottom and the side walls of the container for maintaining the integrity and taste of the food product. In addition, the food product is suspended in the container for enhancing the moisture content of the breast portion of a fowl food product. Through the practice of the present invention, the food product has substantially the same appearance and taste as the food product appeared to the consumer in a display warmer. The improved carrying container of the present invention may be easily manufactured with only a moderate increase in cost.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A carrying container for a food product, comprising;

a container having a bottom wall and side wall means for defining a container interior;

said side wall means including a first and a second wall with said first wall being opposed to said second wall;

a first and a second aperture defined in said first and second walls, respectively;

a skewer rod extending between a first and a second rod end;

said skewer rod being adapted to impale the food product with said first and second rod ends extending therefrom;

said first and second rod ends of said skewer rod being insertable within said first and second apertures in said first and second walls, respectively, for supporting the food product within said container interior of said container;

said first and second apertures being positioned in said first and second walls for spacing the food product from said bottom wall and said side walls means; and said first and second apertures comprising a first and a second expandable aperture defined in said first and second walls for respectively frictionally engaging said first and second rod ends of said skewer rod.

2. A carrying container for a food product as set forth in claim 1, wherein said container comprises a cardboard formed from a unitary cardboard blank.

3. A carrying container for a food product as set forth in claim 1, wherein said side walls means defines a container opening; and a container cover engagable with said side walls means for closing said container opening.

4. A carrying container for a food product as set forth in claim 1, wherein said side wall means defines a container opening;

a container cover engagable with said side walls means for closing said container opening; and said container cover being integrally formed with said container.

5. A carrying container for a food product as set forth in claim 1, including a carrying handle secured to said container for facilitating transportation of the container.

6. A carrying container for a food product as set forth in claim 1, including a carrying handle secured to said container for facilitating transportation of the container; and said handle being integrally formed with said container.

7. A carrying container for a food product as set forth in claim 1, wherein said skewer rod includes an annular recess located proximate to said first rod end; and said annular recess of said skewer rod receiving an edge of said first aperture in said first opposing wall for inhibiting axial displacement of said skewer rod relative to said side wall means of said container.

8. A carrying container for a food product as set forth in claim 1, wherein said skewer rod includes an annular recess located proximate to said first rod end;

said annular recess of said skewer rod receiving an edge of said first aperture in said first opposing wall for inhibiting axial displacement of said skewer rod relative to said side wall means of said container; and said skewer rod being usable as a toy drum stick after removal of said skewer rod from the container and after removal of said skewer rod from the impaled food product.

9. A carrying container for a food product as set forth in claim 1, wherein said side wall means includes a portion thereof being transparent for enabling the observation of the food product within said container interior of said container.

10. A carrying container for a food product as set forth in claim 1, wherein said skewer rod is rotatable within said first and second apertures for enabling a fowl food product to be suspended with a breast portion of the fowl positioned downwardly for enhancing a moisture content of the breast portion of the fowl.

* * * * *